US010337516B2

(12) United States Patent
Vinther Toft et al.

(10) Patent No.: US 10,337,516 B2
(45) Date of Patent: Jul. 2, 2019

(54) MULTI-STAGE, SELF-PRIMING CENTRIFUGAL PUMP ASSEMBLY

(71) Applicant: GRUNDFOS HOLDING A/S, Bjerringbro (DK)

(72) Inventors: Bjarne Vinther Toft, Randers SV (DK); Aage Bruhn, Bjerringbro (DK)

(73) Assignee: GRUNDFOS HOLDING A/S, Bjerringbro (DK)

( * ) Notice: Subject to any disclaimer, the term of this patent is extended or adjusted under 35 U.S.C. 154(b) by 609 days.

(21) Appl. No.: 14/892,774

(22) PCT Filed: Apr. 29, 2014

(86) PCT No.: PCT/EP2014/058643
§ 371 (c)(1),
(2) Date: Nov. 20, 2015

(87) PCT Pub. No.: WO2014/187648
PCT Pub. Date: Nov. 27, 2014

(65) Prior Publication Data

US 2016/0084253 A1 Mar. 24, 2016

(30) Foreign Application Priority Data

May 22, 2013 (EP) ..... 13168801

(51) Int. Cl.

| | |
|---|---|
| ***F04D 1/10*** | (2006.01) |
| ***F04D 1/06*** | (2006.01) |
| ***F04D 9/00*** | (2006.01) |
| ***F04D 9/02*** | (2006.01) |
| ***F04D 13/06*** | (2006.01) |

(Continued)

(52) U.S. Cl.
CPC ..... *F04D 1/10* (2013.01); *F04D 1/063* (2013.01); *F04D 9/003* (2013.01); *F04D 9/02* (2013.01); *F04D 13/06* (2013.01); *F04D 15/0011* (2013.01); *F04D 29/043* (2013.01);
(Continued)

(58) Field of Classification Search
CPC . F04D 9/02; F04D 9/002; F04D 9/003; F04D 9/007; F04D 9/005
See application file for complete search history.

(56) References Cited

U.S. PATENT DOCUMENTS 1,755,217 A 4/1930 Jacobsen
1,855,061 A 4/1932 Lauchenauer
(Continued)

FOREIGN PATENT DOCUMENTS

BE 440 219 A 2/1941
CH 240 031 A 11/1945
(Continued)

OTHER PUBLICATIONS

Lu, Chunming; CN2209725, Oct. 11, 1995, translation.*
D'Urso, Nicola; FR936832, Jul. 30, 1948, translation.*

*Primary Examiner* — Woody A Lee, Jr.
*Assistant Examiner* — Jason A Fountain
(74) *Attorney, Agent, or Firm* — McGlew and Tuttle, P.C.

(57) ABSTRACT

A multi-stage, self-priming centrifugal pump assembly includes at least two pump stages (4) which are consecutive in a main flow direction (32), and a backflow channel (13) which lies parallel to at least one a pump stage (4). The backflow channel (13) runs out downstream of the first or a further pump stage (4), in the main flow direction (32).

18 Claims, 6 Drawing Sheets

(51) Int. Cl.

| | |
|---|---|
| ***F04D 15/00*** | (2006.01) |
| ***F04D 29/043*** | (2006.01) |
| ***F04D 29/22*** | (2006.01) |
| ***F04D 29/42*** | (2006.01) |
| ***F04D 29/44*** | (2006.01) |
| ***F04D 29/70*** | (2006.01) |

(52) U.S. Cl.
CPC ..... *F04D 29/22* (2013.01); *F04D 29/426* (2013.01); *F04D 29/445* (2013.01); *F04D 29/70* (2013.01)

(56) References Cited

U.S. PATENT DOCUMENTS

| | | | | |
|---|---|---|---|---|
| 2,100,365 | A | 11/1937 | Stratton | |
| 2,458,607 | A | 1/1949 | Lauchenauer | |
| 3,726,618 | A | 4/1973 | Dicmas | |
| 3,867,056 | A | 2/1975 | Carle et al. | |
| 4,842,480 | A | 6/1989 | Jensen et al. | |
| 6,071,072 | A * | 6/2000 | Chang | F04D 9/007 415/56.2 |
| 9,879,680 | B2 * | 1/2018 | Mikkelsen | F04D 9/005 |
| 2012/0251308 | A1 * | 10/2012 | Mikkelsen | F04D 1/063 415/198.1 |

FOREIGN PATENT DOCUMENTS

| | | | |
|---|---|---|---|
| CN | 2209725 | Y | 10/1995 |
| CN | 2761884 | Y | 3/2006 |
| CN | 101418804 | A | 4/2009 |
| CN | 201610847 | U | 10/2010 |
| CN | 202326278 | U | 7/2012 |
| CN | 102734176 | A | 10/2012 |
| DE | 368 554 | C | 2/1923 |
| DE | 44 15 157 | A1 | 11/1995 |
| EP | 2 505 842 | A1 | 10/2012 |
| FR | 936 832 | A | 7/1948 |
| GB | 490 907 | A | 8/1938 |
| GB | 1375927 | A | 12/1974 |

* cited by examiner

Fig.4
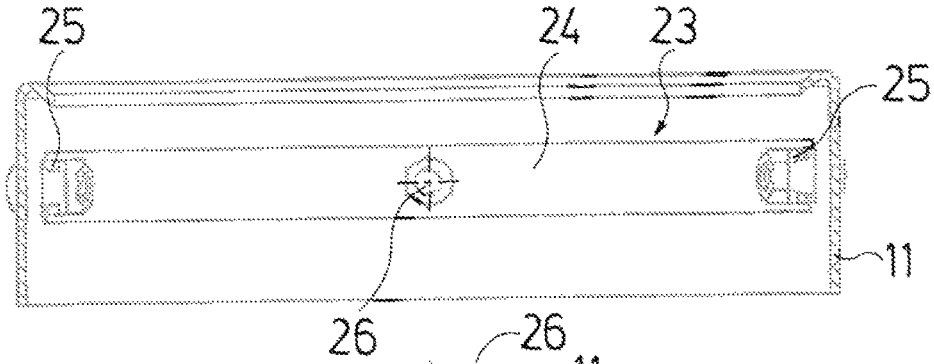
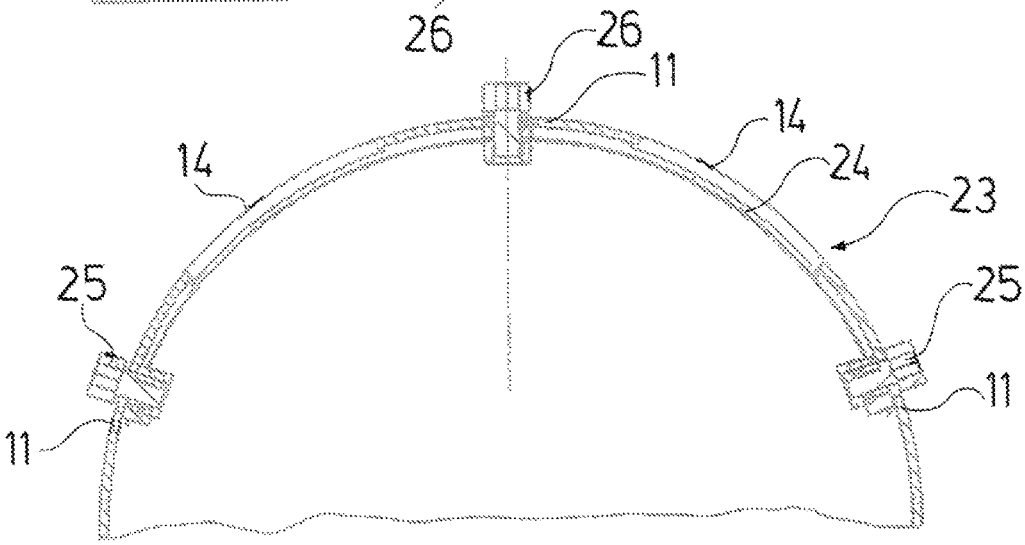
Fig.5

MULTI-STAGE, SELF-PRIMING CENTRIFUGAL PUMP ASSEMBLY

CROSS REFERENCE TO RELATED APPLICATIONS

This application is a United States National Phase Application of International Application PCT/EP2014/058643 filed Apr. 29, 2014 and claims the benefit of priority under 35 U.S.C. § 119 of European Patent Application 13 168 801.2 filed May 22, 2013 the entire contents of which are incorporated herein by reference.

FIELD OF THE INVENTION

The invention relates to a multi-stage, self-priming centrifugal pump assembly with at least two pump stages which are consecutive in a main flow direction and with a backflow channel which lies parallel to at least one a pump stage and which runs out downstream of the first or a further pump stage in the main flow direction.

BACKGROUND OF THE INVENTION

A multi-stage centrifugal pump assembly according to the preamble is known from EP 2 505 842 A1, which is designed such that a self-priming behavior is achieved with only a small quantity of delivery fluid. The centrifugal pump assembly described there has proven its worth, but requires a certain start-up time for the self-priming process.

From DE 44 15 157 A1, it is counted as belonging to the state of the art, with a multi-stage centrifugal pump, to lead back the delivery fluid during the suction phase by way of opening a non-return valve. Moreover, an air separator is provided, so that the air located in the assembly, during the suction phase, can be replaced by fluid which is stored in a chamber of the pump, by which means a self-priming of the pump can be ensured.

SUMMARY OF THE INVENTION

It is an object of the present invention, to further improve a centrifugal pump assembly of the type according to the preamble, with respect to its self-priming behavior.

The multi-stage, self-priming centrifugal pump assembly according to the invention comprises at least two pump stages which are consecutive in the flow direction, as well as a backflow channel which lies parallel to at least one pump stage. According to the invention, the backflow channel is designed and arranged such that the backflow channel runs out (has a flow outlet) downstream of the first or a further pump stage, seen in the main flow direction of the pump, and specifically downstream of the diffuser (guide vane mechanism) of the pump stage, seen in the main flow direction.

The basic concept of the solution according to the invention is not to arrange the backflow channel parallel to the first pump stage, as is the case with the state of the art, but to arrange this in parallel to the second or one or more further pump stages. Thereby, with regard to the centrifugal pump assembly according to the invention the pump stages are arranged vertically above one another. Surprisingly, it has been found that if, according to the invention, the backflow channel is arranged downstream of the first or a further pump stage seen in the main flow direction of the pump, and specifically downstream of the diffuser of the pump stage, the procedure of the self-priming is effected in a significantly more intensive manner and in particular in a shorter temporal course, which is advantageous since the time of the self-priming of the pump is shortened and thus the pump is available for its envisaged application, for example for delivering extinguishing fluid, at a much earlier stage. Although a certain basic quantity of fluid is required with the centrifugal pump assembly according to the invention, in order to initiate the self-priming procedure, the subsequent suctioning i.e. the generation of a vacuum is effected significantly more quickly than with pumps according to the state of the art. Unnecessary eddying in the led-back fluid is prevented in the region of the diffuser due to the fact that the leading-back of the delivered fluid is not effected between the impeller and the diffuser, as is known from the state of the art, but downstream of the diffuser in the flow direction. The part of the fluid which is delivered through the pump stage/pump stages before the run-out of the return channel, is led through the diffuser without disturbing influences of the led-back fluid, which is to say that the kinetic energy at the exit of the impeller can be converted into pressure energy by the subsequent diffuser and only then is a mixing with the led-back fluid effected. A significant improvement of the self-priming procedure can be achieved on starting the pump by way of this.

It is advantageous if the backflow channel runs out downstream of the first pump stage seen in the main flow direction, thus downstream of the diffuser of the first pump stage, at the exit of this pump stage which is at the flow side. The backflow channel according to the invention can thereby bridge one or more pump stages and preferably this should bridge at least two pump stages. A particularly quick and good suction behavior results if the suction channel bridges four pump stages, thus for example is led parallel to the second to fifth pump stage. It is advantageous if the backflow channel seen in the main flow direction runs out downstream of the first pump stage, thus downstream of the diffuser of the first pump stage, at the exit of this pump stage which is at the flow side.

It is advantageous to provide a gas separator within the centrifugal pump assembly, said gas separator according to a further development of the invention preferably being arranged at the exit side of the at least second pump stage, in order to design the suction procedure as effectively as possible. With regard to the main flow direction, it is useful to arrange the gas separator downstream of the pump stages provided for the suction procedure, thus subsequently to the pump stages to which the backflow channel lies in parallel.

According to one advantageous design of the invention, the gas separator is formed by a housing-fixed, tubular body which connects onto a diffuser of a pump stage and which in its wall comprises at least one recess connected to the backflow channel in a fluid-leading manner. Such an arrangement is inexpensively manufacturable and highly effective, since the conveying fluid gas mixture exiting the diffuser with swirling rises helically on the tubular body and due to the centrifugal force gets through the at least one recess in the wall and thus into the backflow channel, whereas the gas is led upwards and is thus removed from the suction circulation.

According to an advantageous further development of the invention, a buffer chamber is arranged between two pump stages which are subsequent to the first pump stage in the main flow direction. Such a buffer chamber is preferably arranged downstream of the gas separator in the main flow direction. The buffer chamber serves for storing a certain quantity of water within the pump and in particular when suctioning larger air bubbles, as can occur for example on suctioning an emptying tank towards the end, ensures that these air bubbles do not lead to water necessary for the suctioning procedure being delivered out of the pump. The buffer chamber is therefore to be designed such that on the one hand it is automatically filled given flow through the pump, but on the other hand that it releases the delivery fluid stored there, at least in a delayed manner, i.e. leads it via the backflow channel back again into the pump stages provided for the suctioning procedure.

According to the invention, such a buffer chamber can advantageously be formed by a housing-fixed, tubular body which surrounds the common drive of the centrifugal pump assembly at a distance and which is arranged at a distance to the outer housing wall. This tubular body is connected via an annular base which on the one hand is connected to the tubular body and on the other hand to the wall of the pump and comprises at least one recess connected to the backflow channel in a fluid-leading manner. It is therefore the case of an annular storage reservoir between the tubular body and the pump wall, in which recesses are provided on the base side and these recesses are designed such that the backflow through these recesses with regard to time runs such that an entrained large gas bubble does not lead to the self-priming behavior being compromised.

According to a further development of the invention, one envisages the backflow channel being able to be shut off via a valve controlled in a pressure-dependent manner, on the one hand to ensure a good suctioning behavior and on the other hand however to ensure that no efficiency reduction of the pump is effected by the backflow channel in normal operation.

Preferably, such a valve is provided at the entry side of the backflow channel, since a comparatively high pressure of the fluid delivery already prevails there at the exit of a second pump stage or one lying thereabove, and this high pressure can be used for the control of the valve, in particular for its shut-off. The valve is advantageously controlled by differential pressure, and specifically in dependence on the differential pressure at the backflow channel, so that the backflow channel is shut off on exceeding a predefined differential pressure. In this manner, it is ensured that the backflow channel is only effective for the actual suctioning procedure and has no efficiency-worsening influence in normal operation of the pump.

Preferably, the backflow channel is designed as an annular channel which surrounds at least, one preferably however two to four pump stages.

According to a further development of the invention, means for preventing the pump from running empty are provided. These are to be selected depending on the application of the pump. Thus, according to the invention, if the assembly is envisaged and designed exclusively for operation with pump stages arranged vertically above one another and comprises a suction connection at the foot of the pump, a pipe section can be arranged upstream of this suction connection, and this pipe section extends laterally of the assembly, preferably up to the height of the last pump stage. By way of this pipe section, it is ensured that the centrifugal pump assembly cannot run empty due to the backflow of delivery fluid. Thus, the self-priming behavior also largely ensured in this manner. Thereby, basically the pipe section arranged upstream is to be led up so high, that at least one of the pump stages lying in the region of the backflow channel and are thus are required for the self-priming behavior, is reached.

According to an advantageous further development of invention, the pipe section arranged upstream is designed in a U-shaped manner and at its region connecting the limbs of the U, thus at its upper end, is provided with a ventilation opening which can be selectively opened and closed by way of a ventilation valve. The ventilation opening in particular with a suction conduit leading further downwards, ensures that the pipe section arranged upstream and thus also the pump connecting thereto are prevented from being suctioned dry due to the vacuum in the suction conduit. Then the part of the suctioning conduit leading the vacuum can be filled with air by way of opening the valve, thus by way of releasing the ventilation opening, so that the other limb of the pipe section and thus also the pump itself remain filled with fluid, with a later starting operation of the pump, and the pump starts up again in a self-priming manner. Advantageously thereby, the ventilation opening is conductively connected to the pressure space of the last pump stage amid the intermediate connection of the ventilation valve, so that given an opened ventilation valve, it is always ensured that the pipe section close to the pump, as well as the pump itself remain filled with fluid, irrespective of the pressure conditions in the other pipe section, thus at the suctioning conduit.

Advantageously, an electrically controllable solenoid valve is applied as a ventilation valve. Such valves are inexpensive, reliable and simple to activate.

Alternatively, a non-return valve can also be arranged on the suction side, i.e. upstream of the first pump stage, for preventing the pump from running empty. Such a non-return valve can be part of the pump assembly or also be arranged in a pipe section arranged upstream on the suction side.

Advantageously, a delivery connection is arranged in the foot of the pump and is conductively connected via an annular space to the last pump stage. A pump of the inline construction manner is formed by way of this.

According to the invention, advantageously an electric motor which drives a central shaft carrying the impellers is provided for the drive of the centrifugal pump assembly. The motor is advantageously arranged on the upper side of the assembly.

The invention is hereinafter explained by way of embodiment examples represented in the drawing.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

BRIEF DESCRIPTION OF THE DRAWINGS

In the drawings:

FIG. 4 is an enlarged longitudinal sectional view of a pressure-side housing region behind the fourth pump stage;

FIG. 5 is a cross sectional view of the housing region according to FIG. 4;

DESCRIPTION OF THE PREFERRED EMBODIMENTS

Figure 1:
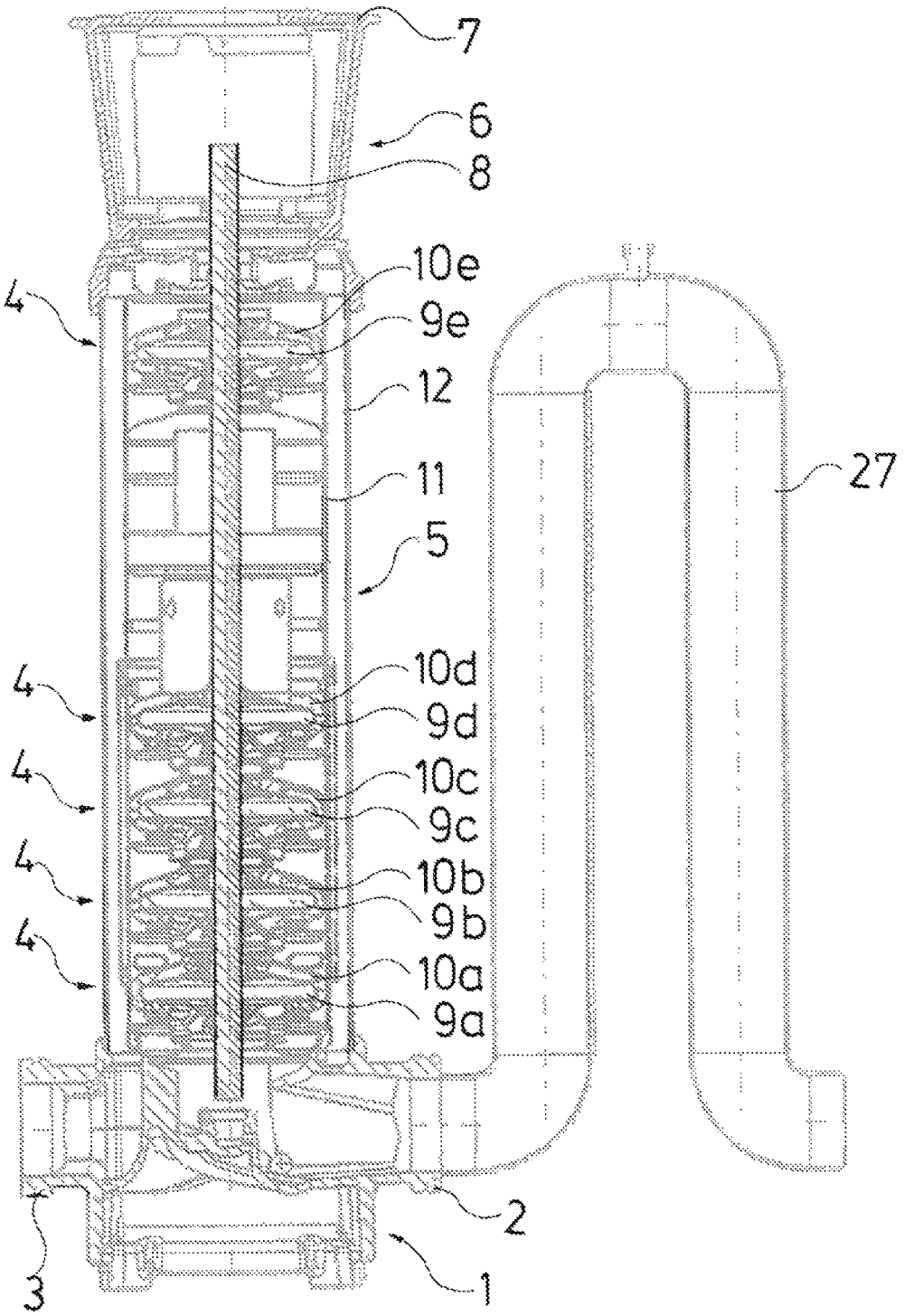
FIG. 1 is a greatly simplified schematic longitudinal sectional view through a centrifugal pump assembly according to the invention.
Figure 2:
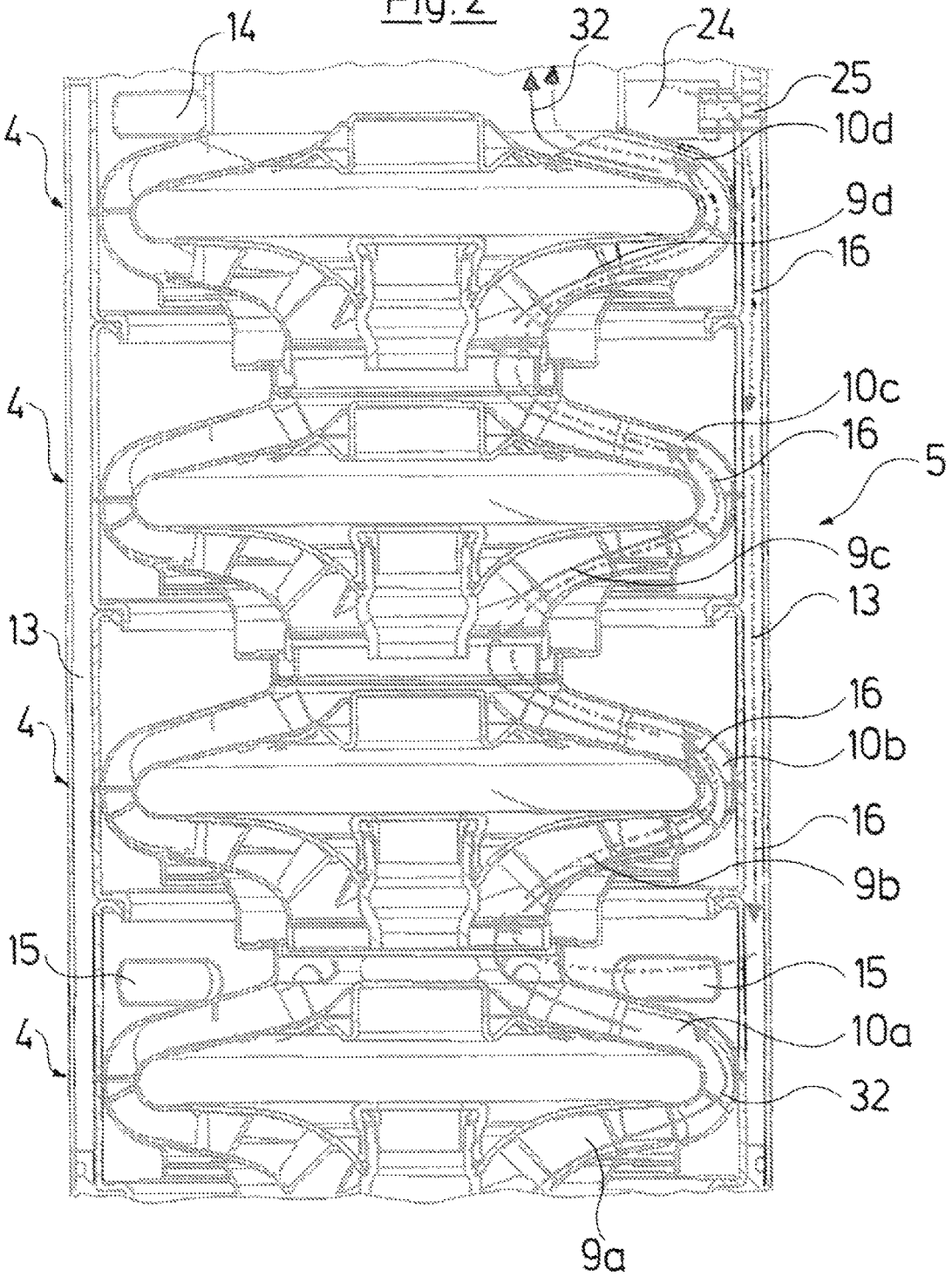
FIG. 2 is an enlarged view of a region of the first four pump stages of FIG. 1.
Figure 3:
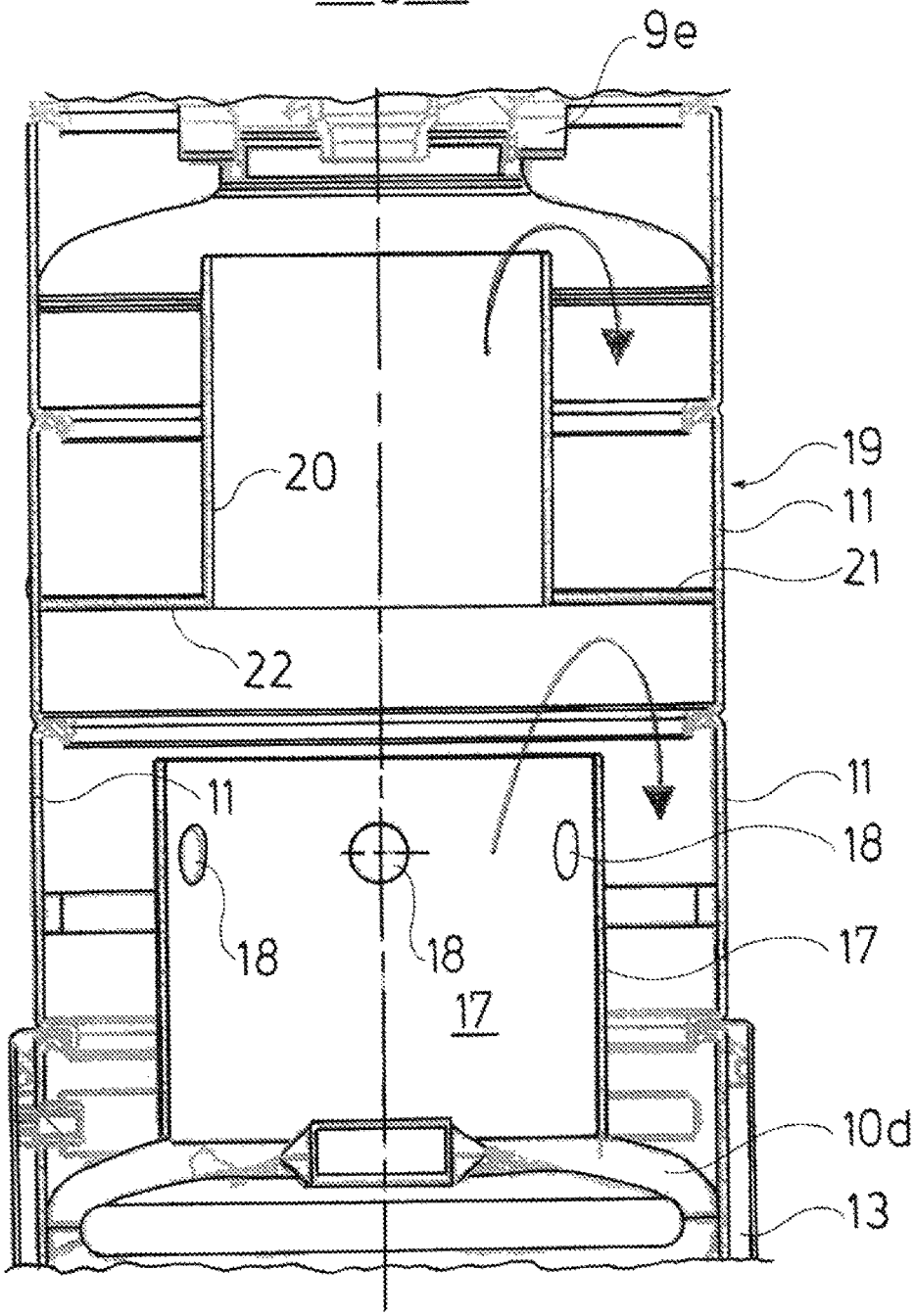
FIG. 3 is an enlarged view of a region between the fourth and the last pump stage in FIG. 1.
Figure 6:
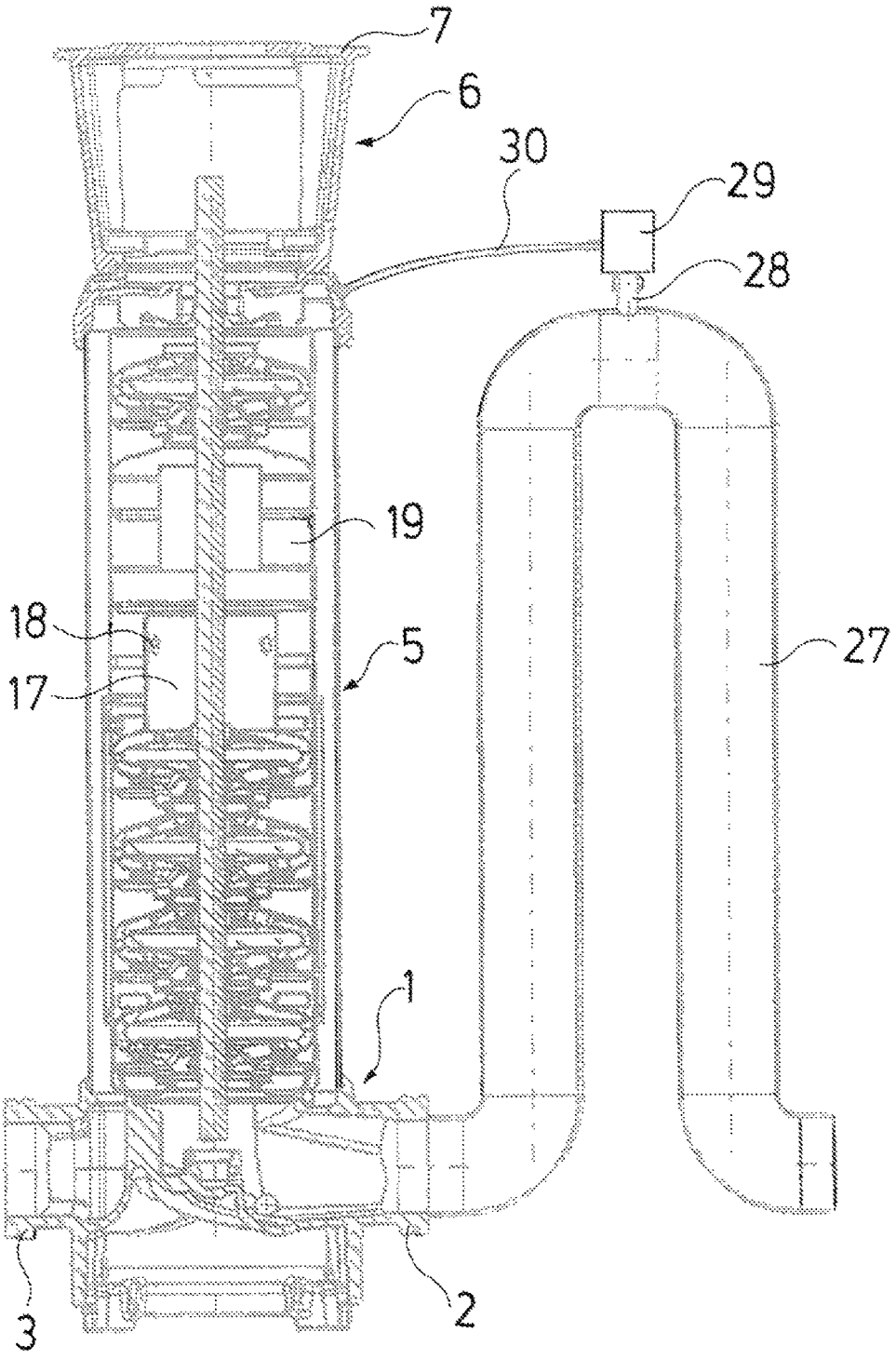
FIG. 6 is a greatly simplified schematic longitudinal sectional view of the centrifugal pump assembly according to FIG. 1, with an incorporated valve.

With regard to the centrifugal pump assembly represented by way of the FIGS. 1 to 5, it is the case of a multistage, self-priming centrifugal pump assembly of the inline construction type which is envisaged for vertical operation, thus standing upright. Thereby, only the pump-side part of the centrifugal pump assembly which is provided on a foot part 1 for standing placement on a horizontally aligned surface and which comprises a suction connection 2 as well as a delivery connection 3 aligned thereto, as is common with inline pumps, is represented in FIG. 1. A middle pump part 5 connects to this foot part 1 formed as a cast metal component and this middle pump part comprises the pump stages 4 and at its upper end is closed off by a head part 6 likewise formed from cast metal and simultaneously forming a motor base 7 for the electric motor to be connected there. This (not shown) electric motor is connected via a (likewise not represented) coupling to a central shaft 8 which passes through the pump from the head part 6 to the foot part 1, is rotatably mounted and carries impellers 9 of the pump stages 4.

The pump represented by way of FIGS. 1 to 5 as a whole comprises five pump stages 4 which are connected hydraulically in series so that the delivery fluid is led from the suction connection 2 firstly to the lowermost, first impeller 9*a*, from there into the diffuser 10*a* assigned to this impeller 9*a* and leading the delivery fluid to the pump stage arranged downstream, specifically to the suction port of the impeller 9*b* of the second pump stage to which second pump stage a diffuser 10*b* leading the fluid to the suction port of an impeller 9*c* of the third pump stage is assigned. The fourth pump stage consisting of the impeller 9*d* and the diffuser 10*d* connects to the third pump stage which is closed off by the diffuser 10*c*. Finally, the pump close to its upper end comprises a fifth pump stage consisting of an impeller 9*e* and a diffuser 10*e*.

The pump stages 4 are arranged in a cylindrical inner casing 11 which is surrounded at a radial distance by a likewise cylindrical outer casing 12. The delivery fluid is led via the annular space formed between the inner casing 11 and the outer casing 12, from the exit of the diffuser 10*e* of the uppermost, fifth pump stage back downwards to the lower foot part 1 and there to the delivery connection 3.

The basic construction of the pump as well as the pump stages in each case consisting of an impeller 9 and a diffuser 10 corresponds to that which is common, is counted as belonging to the state of the art and is therefore not described in detail here.

In order to design the pump in a self-priming manner, i.e. to ensure with regard to design that a self-priming effect happens at least when a small quantity of fluid is located within the pump, several design measures are envisaged with the represented centrifugal pump.

Thus a backflow channel 13 is provided, which is formed by a cylindrical intermediate wall arranged at a small distance to the inner casing 11 between the exit of the first pump stage and the exit of the fourth pump stage and is otherwise connected at the ends to the inner casing 11 in a fixed and sealed manner. The backflow channel 13 arises due to radial recesses 14 above the fourth pump stage, thus above the diffuser 10*d* of the fourth pump stage in the inner casing 11. The backflow channel 13 runs as an annular channel downwards from the recesses 14, where it runs out through recesses 15 between the diffuser 10*a* at the exit side of the first stage and the impeller 9*b* at the entry side of the second pump stage. This backflow channel 13 thus short circuits the fourth pump stage with the exit of the first pump stage, so that the delivery fluid during a suctioning phase of the pump after switching on firstly circulates between the second and the fourth pump stage, as is indicated by the interrupted lines 16 in FIG. 2, said lines representing the suctioning fluid circulation. The self-priming is effected in a comparatively rapid manner due to the fact that the backflow channel 13 is not led back to the entry of the first pump stage as is the case with the state of the art, but to the entry of the second pump stage.

A gas separator 17 in the form of a cylindrical pipe section is formed at the exit side of the fourth pump stage within the inner casing 11, in a manner connecting to the diffuser 10*d* of this stage, and this pipe section is arranged in a manner fixed to the housing and coaxially to the shaft 8 and in the region of the upper third of its length is provided with circular recesses 18. The pipe forming the gas separator 17 with regard to height corresponds roughly to two pump stages. The gas separator 17 has the effect that on interruption of the flow of the fluid due to a relatively large gas bubble, this can rise centrally, whereas the fluid which exits from the diffuser 10*d*, due to the swirling which is still present and the centrifugal force resulting from this, exits through the openings 18 to the outside and then flows back at the outer periphery within the inner casing 11 or rises further upwards, without the delivery flow breaking away due to this.

A buffer chamber 19 which is delimited inwards coaxially to the shaft 8 by a cylindrical pipe section 20, is delimited to the outside by the inner casing 11 and is delimited to the bottom by an annular base 21, connects onto the gas separator 17 to the top at a distance. The base 21 is provided with recesses 22 which are dimensioned such that the buffer chamber 19 due to the recesses 22 in the base 21 empties only very slowly but not spontaneously, thus that delivery fluid firstly remains in this region of the pump even in the case of a passage of larger gas quantities. The suction port of the impeller 9*e* of the fifth pump stage connects to the top onto the cylindrical pipe section 20 at a distance. The delivery fluid which gets through the pipe section 20 thus at least partly flows into the buffer chamber 19 arranged laterally next to it and from there, as long as these spaces are not filled with delivery fluid as in normal pump operation, back to the fourth pump stage and from there via the backflow channel 13 to the entry of the second pump stage. In this manner, even with the occurrence of larger gas bubbles, it is always ensured that sufficient delivery fluid remains within the pump, in order to ensure the continuous delivery operation.

A pressure-controlled valve 23 is provided which, when the pressure at the exit of the fourth pump stage rises above a certain value, specifically when the actual suctioning procedure is completed, closes the recesses 14 in the inner casing 11, in order to prevent losses arising after the suctioning phase in the actual delivery operation due to delivery fluid flowing back though the backflow channel 13. For this, the valve 23 comprises a sheet-metal strip 24 which is arranged within the cylindrical outer inner contour in a limitedly movable manner, at its two ends is designed in a fork-like manner and is connected to the inner casing 11 in a limitedly movable manner within this by way of screws 25. The sheet-metal strip 24 in the region of the screws 26 is held in a manner distanced to the inner casing 11 via a screw 26 in the inner casing 11, said screw being arranged centrally between the screws 25 and between the two recesses 14. The sheet-metal strip 24 which is formed from spring steel is elastically deformed with an increasing inner pressure and is pressed radially outwards in a manner closing the recesses 14. As soon as the inner pressure drops below a certain value, the sheet-metal strip 24 again assumes its original shape represented in FIG. 5 and thus opens the recesses 14.

A U-shaped pipe section 27 is arranged upstream of the suction connection 2 in order to prevent the centrifugal pump from running empty after switching off for example, and this pipe section with regard to height extends up to the fifth pump stage, so that the pump itself and the limb of the U-shaped pipe section 27 which is on the left in FIG. 1 always remains filled with delivery fluid.

Thereby, in a further development, the U-shaped pipe section 27 at its uppermost location, thus in the web region of the U can comprise a bleed connection 28 which is closed by way of a solenoid valve 29. This bleed connection 28 is connected to the pressure space of the last pump stage via a flexible tube 30. The solenoid valve 29 is closed in the non-actuated condition and is opened by way of a suitable (not shown) control, given a pressure drop in the pressure space of the last pump stage, in order to ensure that sufficient delivery fluid always remains within the pump and the self-priming capability is retained.

Figure 7:
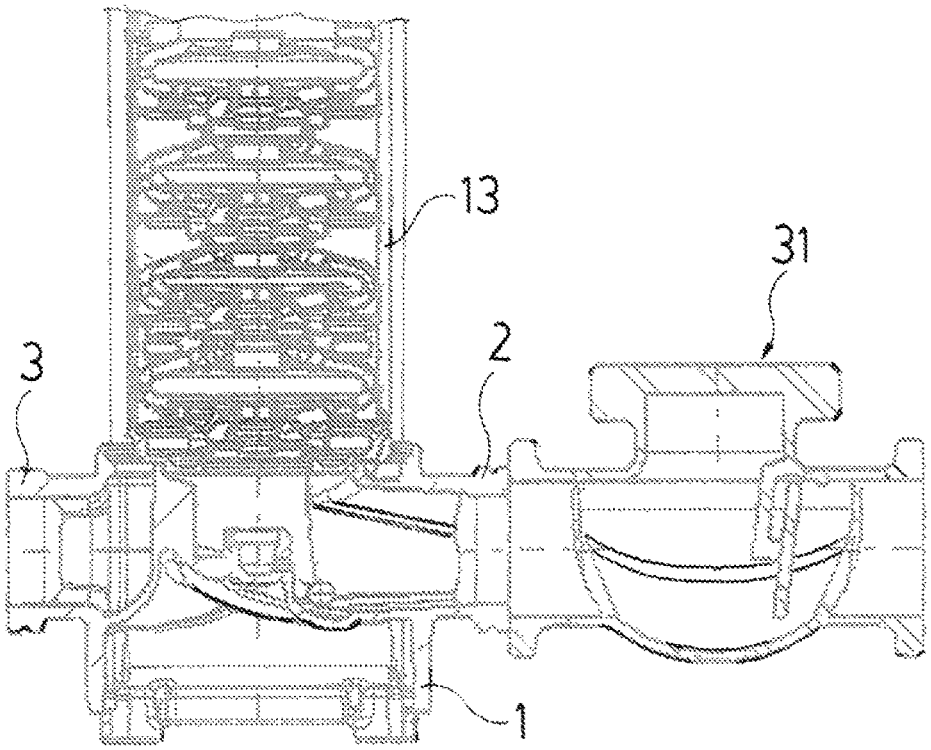
FIG. 7 is a greatly simplified schematic longitudinal sectional view showing one embodiment variant with a non-return valve connected upstream, according to FIG. 1.

With the embodiment according to FIG. 7, a non-return valve 31 is provided on the suction side instead of the U-shaped pipe section 27 and the bleed opening 28, and this valve endures that delivery fluid can only flow into the pump but not out of this at the suction side, and the self-priming capability is also ensured by way of this.

While specific embodiments of the invention have been shown and described in detail to illustrate the application of the principles of the invention, it will be understood that the invention may be embodied otherwise without departing from such principles.

The invention claimed is:

1. A multi-stage, self-priming centrifugal pump assembly comprising:

at least two pump stages which are consecutive in a main flow direction and which include a diffuser; and a backflow channel which lies parallel to at least one pump stage and which runs out downstream of the first or a further pump stage in the main flow direction, wherein the backflow channel runs out downstream of the diffuser of the at least one pump stage, wherein the backflow channel is an annular channel surrounding at least one pump stage.

2. The centrifugal pump assembly according to claim 1, wherein the backflow channel runs out downstream of the diffuser of a first pump stage of the at least two pump stages, in the main flow direction.

3. The centrifugal pump assembly according to claim 1, further comprising a gas separator is arranged at an exit side of the at least second pump stage.

4. The centrifugal pump assembly according to claim 3, wherein the gas separator is formed by a housing-fixed, tubular body which connects onto the diffuser of one of the at least two pump stages and the gas separator comprises a wall that comprises at least one recess fluidically connected to the backflow channel.

5. The centrifugal pump assembly according to claim 3, further comprising a buffer chamber arranged between two pump stages of the at least two pump stages which follow the first pump stage in the main flow direction, and downstream of the gas separator in the main flow direction.

6. The centrifugal pump assembly according to claim 5, wherein the buffer chamber is formed by a housing-fixed, tubular body, a housing wall surrounding the tubular body and spaced at a distance and an annular base connecting the tubular body and the housing wall, said base comprising at least one recess which is connected to the backflow channel in a fluid-leading manner.

7. The centrifugal pump assembly according to claim 1, wherein a valve is provided on an entry side of the backflow channel and the valve is controlled in a pressure-dependent manner and shuts off the backflow channel on exceeding a predefined differential pressure.

8. The centrifugal pump assembly according to claim 1, further comprising empty running prevention means for preventing an empty running of the pump are provided.

9. The centrifugal pump assembly according to claim 1, wherein the at least two pump stages comprise pump stages arranged vertically above one another and further comprising a suction connection at a foot of the pump and a pipe section which extends laterally of the assembly up to a height of a last pump stage, is arranged upstream of the suction connection.

10. The centrifugal pump assembly according to claim 9, wherein the pipe section arranged upstream is configured with a U-shape with a region connecting the limbs of the U shape provided with a ventilation opening which can be selectively opened or closed by way of a ventilation valve.

11. The centrifugal pump assembly according to claim 10, wherein the ventilation opening is conductively connected to a pressure space of the last pump stage, amid an intermediate connection of the ventilation valve.

12. The centrifugal pump assembly according to claim 10, wherein the ventilation valve is an electrically controllable solenoid valve.

13. The centrifugal pump assembly according to claim 1, further comprising a non-return valve arranged upstream of the first pump stage.

14. The centrifugal pump assembly according to claim 9, wherein a delivery connection is conductively connected to the last pump stage via an annular space and is arranged in the foot of the pump.

15. The centrifugal pump assembly according to claim 1, further comprising an electric motor to drive a central shaft carrying impellers and arranged at an upper end of the assembly.

16. A multi-stage, self-priming centrifugal pump assembly comprising:

a plurality of pump stages consecutively arranged in a main flow direction, at least one of the plurality of pump stages comprising a diffuser; and a backflow channel parallel to at least one of the plurality of pump stages, the backflow channel extending downstream of the diffuser of the at least one of the plurality of pump stages in a main flow direction, the backflow channel being downstream of another one of the pump stages, wherein the backflow channel defines at least a portion of a fluid flow path extending from an outlet of the at least one of the plurality of pump stages to a position located between an outlet of the another one of the pump stages and an inlet of the at least one of the plurality of pump stages, wherein the backflow channel is an annular channel surrounding at least one pump stage.

17. A multi-stage, self-priming centrifugal pump assembly comprising:

a first pump stage comprising a first pump stage diffuser;

a second pump stage;

a third pump stage a comprising a third pump stage diffuser, the first pump stage, the second pump stage and the third pump stage being consecutively arranged in a main flow direction; and a backflow channel parallel to at least one of the first pump stage, the second pump stage and the third pump stage, the backflow channel extending downstream of the diffuser of at least the third pump stage diffuser in the main flow direction, wherein the backflow channel defines at least a portion of a fluid flow path extending from an outlet of the third pump stage diffuser to a position located between an outlet of the first pump stage diffuser and an inlet of the second pump stage, wherein the backflow channel is an annular channel surrounding at least one of the first pump stage, the second pump stage and the third pump stage.

18. A multi-stage, self-priming centrifugal pump assembly comprising:

at least two pump stages which are consecutive in a main flow direction and which include a diffuser; and a backflow channel which lies parallel to at least one pump stage and which runs out downstream of the first or a further pump stage in the main flow direction, wherein the backflow channel runs out downstream of the diffuser of the at least one pump stage, the at least two pump stages comprising pump stages arranged vertically above one another and further comprising a suction connection at a foot of the pump and a pipe section which extends laterally of the assembly up to a height of a last pump stage, is arranged upstream of the suction connection, wherein a delivery connection is conductively connected to the last pump stage via an annular space and is arranged in the foot of the pump.

* * * * *